US005413234A

United States Patent [19]

Hekal et al.

[11] Patent Number: 5,413,234

[45] Date of Patent: May 9, 1995

[54] TAMPER EVIDENT CLOSURE

[75] Inventors: Ihab Hekal, Stanford, Conn.; Howard D. Iler, Wheaton, Ill.; Bradley C. Kiss, Lombard, Ill.; Daniel P. Bialka, Lockport, Ill.

[73] Assignee: Continental White Cap, Inc., Downers Grove, Ill.

[21] Appl. No.: 835,137

[22] Filed: Feb. 12, 1992

[51] Int. Cl.[6] ..... B65D 41/02

[52] U.S. Cl. ..... 215/230; 215/262

[58] Field of Search ..... 215/230, 250, 262, 203, 215/270; 116/212, 270, 335

[56] References Cited

U.S. PATENT DOCUMENTS

| | | | |
|---|---|---|---|
| 3,736,899 | 6/1973 | Manske | 215/230 X |
| 4,253,580 | 3/1981 | Doi et al. | 215/230 X |
| 4,721,217 | 1/1988 | Phillips et al. | 215/230 |
| 4,872,570 | 10/1989 | Harding | 215/230 |
| 5,018,632 | 5/1991 | Schmidt | 215/250 X |

*Primary Examiner*—Allan N. Shoap
*Assistant Examiner*—Vanessa Caretto
*Attorney, Agent, or Firm*—Lockwood, Alex, Fitzgibbon & Cummings

[57] ABSTRACT

In accordance with the present invention, an irreversible tamper evident system for a button closure is provided. The irreversible tamper evident system is provided by a color change system carried by the flexible button portion of the closure. The color change system comprises an indicator coating over a dark colored substrate coating. The indicator coat is preferably colored with a light colored transparent colorant such as an orange colored fluorescent dye. The indicator coat is preferably a liquid material which can be cured by evaporation, heat, UV irradiation or the like, to form a solid layer. When the substrate layer and indicator layer are in intimate contact, a first color is observed. Depending upon the relative colors used for this substrate and indicator layers, this first color can be a combination of the colors of the two layer or can be primarily the color of the substrate layer. However, when the layers become separated and the outer layer is spaced from the inner layer, a second color is observed which second color is primarily the color of the indicator coat.

19 Claims, 3 Drawing Sheets

TAMPER EVIDENT CLOSURE

The present invention generally relates to new and useful improvements in closures having end panels of which at least an area is formed to flex when the closure is applied to a container and, more particularly, to a closure wherein the flexible area of the end panel is provided with an irreversible tamper indicating system which is actuated when the flexible area of the end panel flexes from a sealed condition to an unsealed condition.

BACKGROUND OF THE INVENTION

Among the various closures made for the food and beverage industry is a "button" or "pop top" closure wherein the closure contains a flexible portion which assumes a given flexed position to indicate a sealed package and a different position when the package seal is breached. These "button" or "pop top" closures are commonly used in vacuum sealed food products such as baby food products to warn purchasers when the vacuum condition under which the food was packaged has been breached.

Although closures having tamper indicating buttons are predominantly in use in vacuum applications, there also have been more recently developed closures with buttons which are mechanically actuated so as to move from an as formed "down" position to an upwardly projecting "up" position when the closure is properly applied to a container. In this "up" position the closures are further characterized as having energy stored within the closure end panels urging the buttons to their as formed "down" position. Removal of these closures from the containers associated therewith results in the buttons moving to their as formed "down" position due to the release of the energy stored within the end panels.

Closures having end panels incorporating tamper indicating buttons are used extensively for the food industry, especially for vacuum packaged product, because they are effective quick-detection means that lets one know some very important conditions about the container. Typically in vacuum applications, when the container is properly sealed and a vacuum exists therein, the button is in a "down" position while when the container has been opened and the closure reapplied, or the vacuum within the container otherwise lost, the button will be in its "up" position. Additionally, in vacuum package applications, when the closure is first opened and the vacuum is lost, a hissing sound may be heard.

Through the extensive commercial use of such button closures, the purchasing public has become generally aware that if the deflectable section of the button is up then the original seal has been broken and that the container should be rejected. Additionally, in the case where the button closure is used in conjunction with a vacuum package container, the purchasing public has been sensitized to listen for a hiss of air or a "popping" sound to determine whether or not that container has been previously opened.

The popping of the top and, in the case of a vacuum packaged product, the sound associated with the loss of vacuum are indicating means to warn purchasers when the integrity of the package has been breached. These indicators, however, are not fool proof and can be intentionally overridden. For example, it is known that a button closure for a vacuum packaged product can be returned to its "tamper free" state even after the package has been opened. This is accomplished by merely heating the open container and when the container is hot, recapping the closure. This procedure will recreate the vacuum seal and reset the button.

Separate tamper evident means have been used in association with button caps to augment the flip or pop of the button. For example, button caps, and other screw top closures, are often used in association with a shrink wrap. Also, the button cap may be provided with a band at its base, joined to the remainder of the cap through a line of weakness. The band is prevented from rotating or from rising up the screw thread when the cap is unscrewed, and as a result, upon closure opening, the band becomes detached from the remainder of the cap.

The packaging industry has also recognized the desirability of providing a visual means to determine whether the integrity of a sealed container has been breached. For example, U.S. Pat. No. 3,736,899 (Manske) is directed to a pressure change indicator. The '899 patent discloses a button type cap having a flexible panel with a reflective surface and a disk-like element which covers up all or most of the flexible panel when the panel is flexed inward but which provides a gap around the periphery of the panel when it is flexed outward. The gap reveals a highly visible or contrasting color which is seen on the flexible panel either by means of a color on the panel itself or a color on the underside of the disk-like member. The pressure change system of the '899 patent apparently may be reestablished by recreating the vacuum in the package and, accordingly, in such a case would not be irreversible.

U.S. Pat. No. 4,429,803 (Butterfield) is directed to tamper evident means for multiple dose medical vials of the type having a rubber seal closure. The tamper evident means of the '803 patent is a blister-like sac containing a harmless dye. According to the '803 patent, the blister-like sac will release the dye and thereby color the remaining contents of the vial when the vial's seal is broken.

U.S. Pat. No. 4,511,052 (Klein et al.) is directed to a tamper indicating seal for a container. According to the '052 patent a frangible envelope containing an indicator is attached to the band and neck of the container having a closure so that when the closure is opened the frangible envelope will rupture and expose the indicator. The indicator can be a chemical substance which undergoes a change in color when exposed to the atmosphere such as an oxygen or moisture sensitive substance.

U.S. Pat. No. 4,526,752 (Perlman et al.) discloses a tamper evident package incorporating an oxygen sensitive leuco dye. According to the '752 patent, the oxygen sensitive leuco dye is sealed within the package in an anaerobic environment. The package can have a transparent cap through which the oxygen sensitive leuco dye is visible to show the integrity of the package. If oxygen is admitted to the package such as by opening the package, the dye will undergo a color change.

U.S. Pat. No. 4,813,712 (Scopes) is directed to providing a visible indication of whether a button cap is in its concave or convex form. According to the '712 patent the condition of the button can be determined by applying a pattern to the button surface which pattern can display one visible form when the surface is concave and a different visible form when the surface is convex. The different visible forms can include two different colors. In this regard, the '712 patent discloses a button cap having an embossed pattern wherein the pattern displays one color when in a given orientation such as concave and displays a different color when the orientation changes such as to convex. In another embodiment, the pattern is formed of superimposed layers which are displaced relative to one another when the surface changes between its concave and convex forms. Either the layers or the substrate for the layers contains a grid pattern which provides the closure with different appearances in the concave and convex forms. As noted in the '712 patent, a high degree of accuracy is required in laying down the patterns to ensure the colors register correctly with the embossed pattern to produce the desired visual result. Additionally, the surface indicating systems of the '712 patent appear to be reversible.

U.S. Pat. No. 4,877,143 (Travisano) is directed to a closure such as a button cap wherein the button carries an indicator such as a color or an imprinted word like "open" thereon. The indicator is covered with a translucent layer having a light diffusing surface which is provided by a Fresno lens. When the button is in the sealed position, the indicator is drawn away from the translucent/light diffusing layer which results in the indicator being obscured so that it cannot be seen through the translucent layer. When the container is opened and the button flips, the indicator is brought into contact with the translucent layer and the indicator becomes visible therethrough. Similar to the '712 (Scopes) patent above, the tamper evident system of the '143 patent appears to be a reversible system rather than an irreversible system.

Despite recognition of the need for tamper proof or tamper evident button closures, and responsive efforts related thereto there still exists the need for an improved tamper evident button closure.

SUMMARY OF THE INVENTION

The present invention provides an irreversible tamper indicating system for use in conjunction with closures having deflectable end panel areas such as button closures. The irreversible tamper indicating system of the present invention comprises a system which undergoes an irreversible change in color upon deflection of the end panel area such as the flipping of the button of a button cap. The color change system comprises the superimposition of differently colored coatings such as an indicator coating of a first color and a background coating of a second color. Preferably, the indicator coating is a translucent coating containing a light colored colorant and the base coating contains or covers a dark colored colorant. The indicator coating and base coating are placed in intimate contact, either directly or indirectly through intervening coatings such as an adhesive coating, with each other on the surface of closure. When the two coatings are in intimate contact with each other a first color is perceived which is different from the individual color of the indicator coating.

In this regard, without being limited to any theory of the invention, it is believed that when the indicator coating and background coating are in intimate contact with each other the perceived color results in large from light which passes through both the indicator coating and base coating and which is reflected back through those coatings. In accordance with general physical principles, the color perceived is a composite of the colors of the indicator coat and background or base coat which is a function of the absorbance of the light passing through each layer which in-turn is dependent upon the color of the colorants, the concentration of the colorants and the thickness of the coats.

In accordance with the present invention, when the flexible portion of the end panel of the closure incorporating the color evident system of the present invention flexes upon opening of the container, the flexing action actuates a color change by causing the indicator coat to separate from the base coat. When the indicator coat separates from the base coat, a reflection boundary or reflective interface is formed which causes a greater portion of light to be reflected at, as opposed to passing through, the lower surface of the indicator coat. Accordingly, the perceived color is principally the color of the indicator coat rather than a composite color of the indicator coat and base coat.

In accordance with the present invention, the color of the system is determined by the adhesion, or lack thereof, between the indicator coating and button coating. In practice, such as when used for food products, when the sealed container leaves the food packer, the indicator and base coatings are in intimate contact with each other. For practical reasons, the adhesion between the indicator coat and base coat should be sufficient to withstand inadvertent, but tamper free, contact such as that which may occur during transportation and stocking of the product without unintentional separation of the coatings. On the other hand, the adhesion between the indicator coating and button coating must be weak enough so that the flipping action of a button closure can activate the tamper evident system by causing a sufficient loss of adhesion between the indicator coating and base coating.

In accordance with the present invention, the desired adhesion can be achieved through appropriate chemical compositions for the indicator coating and base coating and through the physical dimensions and curing mechanism for the indicator coating. For example, a closure may have a dark inked background and an epoxy ester based coating over its button area. Such a base surface coating can be thermally cured and will exhibit good adhesion to the closure. Alternatively, a base coating can be comprised of other materials, such as an appropriately adhesively backed or otherwise bondable polypropylene film, preferably having a thickness of one mil or less, which will also exhibit good adhesion to the closure. Over the base coating an indicator coating can be applied.

In accordance with the irreversible aspect of the present invention, the coatings must be selected so that once the initial intimate contact between the indicator coating and base coating is broken, it can not be reestablished. An indicator coating that can be readhered to the base coating by drawing the button back down, heat massaging or any other method could defeat the tamper evident feature of the present invention. Accordingly, preferably the indicator coating of the present invention is composed of a resin which can be irreversibly solidified or set. Resins, such as thermoset resins which can be irreversibly set such as by chemical reaction, heat or radiation are preferred. Once this type of indicator coat is fully cured and the intimate adhesion between it and the base coat is broken, such intimate contact cannot be reestablished. The indicator coating preferably includes a UV resin, a photo initiator, a colorant such as a fluorescent dye, flow agents, fillers or other desirable additives. The indicator coating is preferably prepared as a viscous liquid mixture which is spread over the base coating on the button area of the closure. Preferably, the indicator coating has a thickness of between 5 to 20 mils. The indicator coat can then be cured such as by passage through a UV oven to convert the viscous liquid mixture into a solid indicator coat. Examples of materials which can be used for the indicator coating are UV curable acrylates such as acrylated epoxies, acrylated urethanes, acrylated monomers such as TMPTA or TMPTMA and cationically cured epoxies.

In accordance with the present invention, when the tamper evident system is activated the indicator coating becomes separated from the base coating. Therefore, the tamper evident system also preferably includes a flexible transparent coating which will seal the indicator coat to the closure and prevent the actuated delaminated indicator coat from falling off the closure into the container. The overcoat material is selected so that it does not restrict the flipping action of the button, or interfere with the adhesion or release properties of the indicator coat or with the visual appearance of the system. Examples of materials that work well for the overcoat layer include clear, low cross-linked density, acrylated urethanes, two part epoxy and urethane systems, and UV curable cationic systems. Additionally, clear tapes such as polypropylene and polyester films which can be bonded to the closure, such as with adhesives or by heat sealing, can work well as the overcoat layer.

In accordance with the preferred embodiment of the present invention, the indicator coat is cured in a two stage procedure. The first stage curing process transforms the indicator coat mixture from a viscous liquid to a flexible solid which can retain its physical dimensions and its adhesion to the base coating during shipping, closure application to a container, and the inversion of the button when the package vacuum is formed. In this embodiment, the base coat, indicator coat and overcoat can be applied to the button area of the closure at the closure manufacturer's facilities. The closure, with the tamper evident system in place, can then be sent to the supplier of the goods for the container such as to a food packer. The closure would then undergo relatively normal application processes. Once the package is sealed and ready to be cased for shipment, the indicator coat would go through a final and complete cure. The final cure step fully activates the tamper evident system. If the package is then opened the button flips causing the indicator coat to lose adhesion and separate from the base coat which in turn causes an irreversible color change to take place. UV curable acrylate systems are especially well suited for formulating the indicator coat in this application since they lend themselves to different degrees of partial cure and can be subsequently completely cured.

It is hypothesized, without being limited to any particular theory of the invention, that the liquid mixture of the indicator coat completely wets and flows into surface irregularities or disparities such as pores, cavities or the like present in the surface of the base coat. On curing, it is believed that the indicator coat and base coat form a bond perhaps resulting, at least in part, from the mechanical engagement, or interlocking, which occurs by virtue of minute areas of the indicator coat being forced into the surface irregularities of the base coat. When the indicator coat is fully cured and subsequently separated from the base coat it cannot re-wet the surface of the button coat and reestablish the intimate contact originally present between the two coatings. Alternatively, or in combination with the foregoing theory, it is also hypothesized that when the indicator coat is applied in liquid form to the base coat the indicator coat wets the base coat and upon curing the indicator coat sufficiently bonds to the base coat to adhere to the base coat while the button closure experiences the compressive type forces attendant to a vacuum drawn concave button but the bond between the base coat and indicator coat is insufficient to withstand the tension type forces attendant to release of the vacuum and flipping of the button.

In an alternate embodiment of the present invention, a translucent bonding-release layer is interposed between the base coat and indicator coat. In this embodiment, the bonding-release layer acts as a means to bond the indicator coat to the base coat on the button closure prior to the integrity of the closed container being breached. When the container is opened, the flexible end panel is actuated and imparts enough energy to cause the indicator coat to irreversibly separate either alone or along with the bonding-release layer from the base layer. In this embodiment, the indicator coating can be applied as before as a thermoset resin or the indicator coat can be comprised of a preformed colored translucent material such as a translucent plastic disk. Preferably, the bonding-release layer is a photodegradable adhesive. The photodegradable adhesive can be used to sufficiently bond the indicator coat to the base coat at the closure manufacturer's facility. The closure can then be applied to a container and the flexible end panel portion can be set such as by pulling a vacuum thereon during packaging. The closure can then be subjected to an appropriate amount of ultraviolet radiation in order to degrade and weaken the bonding-release photodegradable adhesive. Upon opening of the package, the vacuum seal panel is actuated which imparts enough energy in order to fracture the weakened adhesive and thereby irreversibly allow the indicator coat to separate from the base coat and effect a color change.

Accordingly, it is a general object of the present invention to provide an improved tamper evident closure.

It is another object of the present invention to provide an improved tamper evident button closure.

It is another object of the present invention to provide an improved tamper indicating system in the form of a color change system.

It is another object of the present invention to provide an irreversible tamper evident color change system for a closure which contains a flexible portion which assumes a given position to indicate a sealed package and a different position when the package seal is breached wherein in the sealed position the flexible portion has a first color and in the breach condition the flexible portion has a second color.

These and other objects of the invention will be more fully understood from the following description of the invention with references to the accompanying drawings.

DETAILED DESCRIPTION OF THE PREFERRED EMBODIMENTS OF THE INVENTION

Figure 1:
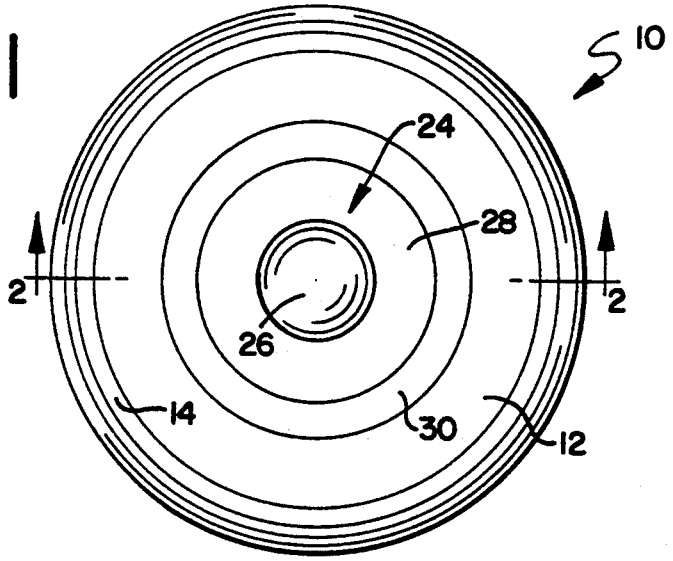
FIG. 1 is a top plan view of a conventional prior art tamper evident closure incorporating a conventional safety button.
Figure 2:
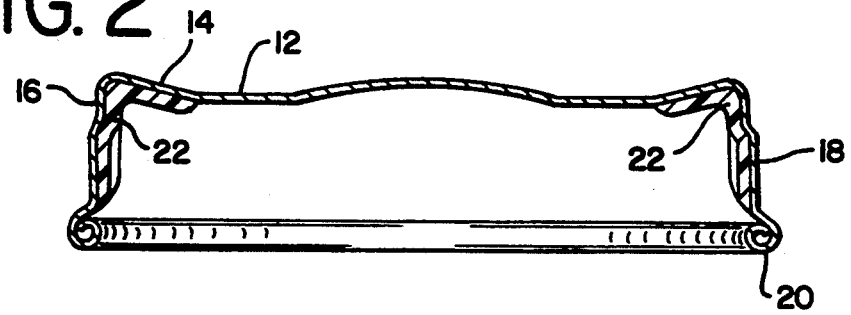
FIG. 2 is a transverse vertical sectional view taken generally along the line 2—2 of FIG. 1 and shows the cross-section of the closure with the button in its "up" convex state.

Referring now to the drawings in detail, reference is first made to FIGS. 1 and 2 which illustrate a typical metallic button closure. The closure is generally identified by the numeral 10 and includes an end panel 12 which has an upwardly and outwardly sloping peripheral portion 14 defining the downwardly opening channel 16. The end panel 12 terminates in a generally cylindrical skirt 18 which, in turn, terminates in an inwardly turned curl 20.

In order that the closure 10 may be applied to a container (not shown) of the type including a neck finish having external threads, the skirt 18 and the channel 16 are lined with a suitable sealing compound 22. When the closure 10 is pressed down on a neck finish of a container, a seal between the closure 10 and the container is formed between that portion of the sealing compound 22 underlying the end panel 12 while an interlock is formed between the threads of the container by that portion of the sealing compound 22 which lines the skirt 18.

The closure 10 is constructed in a manner wherein the end panel 12 is provided with a centrally located button generally indicated by the number 24. The button 24 includes a central post portion 26 surrounded by an upwardly sloping annular portion 28 which, in turn, is surrounded by an annular generally flat portion 30. Preferably, the button 24 is mechanically reformed after its initial formation to a state of compressive residual stress such as by mechanically reforming in the manner described in U.S. Pat. No. 5,016,769 which is incorporated by reference herein.

Figure 5:
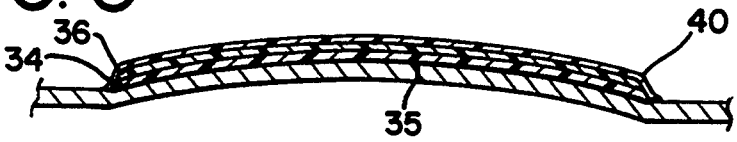
FIG. 5 is an enlarged fragmentary vertical section view similar to that of FIG. 3 which shows further details of an embodiment of the tamper evident system provided on the button including a dark colored substrate layer under an indicator layer under a transparent cover layer.
Figure 6:
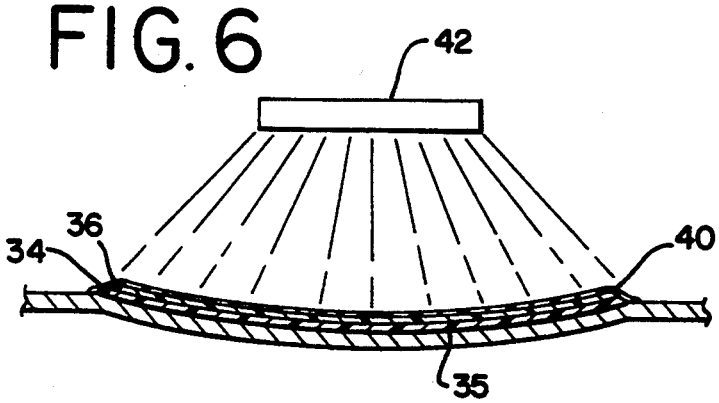
FIG. 6 is a schematic sectional view showing the manner in which the tamper evident system of the present invention may be fully cured after the closure has been applied to a container and the button deformed by a vacuum within the container.

Referring now to FIG. 6, in particular, it will be seen that when a closure 10 is applied to a container and a vacuum is drawn within such container, the button 24 is drawn downwardly. In accordance with the preferred embodiment of the invention, by mechanically reforming the button 24 as the closure 10 is being formed, the button 24 has certain stored stresses which facilitate its being maintained in the "up" normally convexed position of FIGS. 1–5 and 7. When the button 24 is drawn down into the container as shown in FIG. 6, these compressive stresses increase and there is a high tendency for the button 24 to flip upwardly from its "down" concave position of FIG. 6 back to its original "up" convex position. Thus, when the closure 10 is removed from a container and the vacuum applied against the underside of the end panel 12 is released, the button 24 will flip, snap or pop upwardly to its original position. It is this flipping action of the button 24 that actuates the tamper evident color change system of the present invention.

Figure 3:
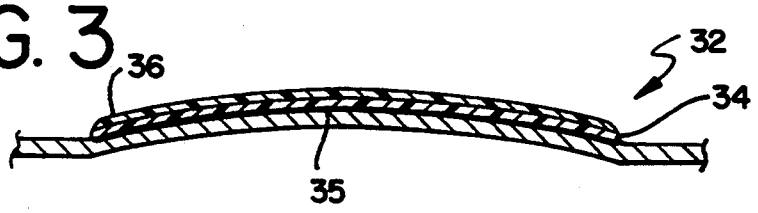
FIG. 3 is an enlargement of the central button portion of FIG. 2 and shows more specifically the details of the tamper evident system of the present invention which includes a dark colored substrate coating under an indicator coating.

The present invention particular relates to a button enhancement color change system which, as shown in FIG. 3, is generally identified by the numeral 32 and which is applied to the button 24. The button color change system 32 is particularly constructed to specifically designate that the closure 10 has been removed from the container even if the closure 10 is again placed on the container in the sealed closed position and thus forms tamper evident means for the closure 10.

The color change system 32 includes a base coat or layer 34 applied to the button 24 for movement with the button 24. The base coat 34 is formulated to adhere to the surface of the button 24 and move with the button 24 without separation from the button 24. It has been found that a thermally curable epoxy ester based coating provides such characteristics when used in conjunction with a metallic closure 10.

In accordance with the color change aspects of the present invention, base coat 34 either contains a colorant, preferably a dark colorant such as a black, blue or dark green colorant or is translucent and overlies a colored background coat 35 on the button 24. The color of the background 35 is preferably dark such as a black ink carried by a curable resin such as the commercially available ink product LA-10022MK supplied by Flint Inc. The background coat 35 can be applied to the button 24 either during the formation of the closure 10 such as by appropriate lithographic application and placement on the sheet metal used to make closure 10 or it can be applied to the button 24 after the closure 10 and button 24 are formed. Similarly, the base coat 34 can be applied to the button 24 either prior to closure 10 formation or after the closure 10 and button 24 are formed.

Figure 8:
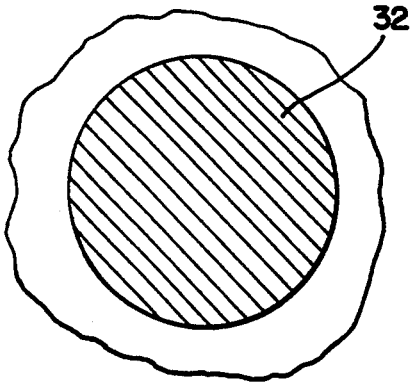
FIG. 8 is a plan view of the button displaying a certain color.
Figure 9:
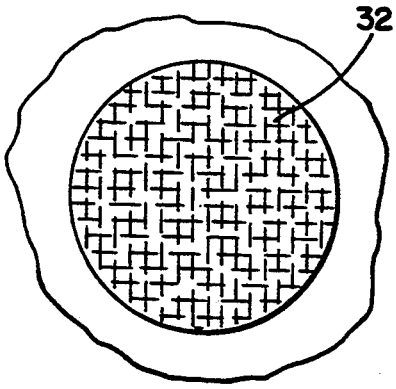
FIG. 9 is a plan view of the button in its condition of FIG. 7 wherein the appearance of the button is of another color.

The color change system 32 also includes an indicator coat or layer 36 which overlies the base coat 34. The indicator coat 36 is translucent and either inherently has a colored appearance or is formulated so as to include a colorant. The color of the indicator coat 36 differs from the effective color (i.e. the color observed through base coat 34 either by having a colored base coat or a translucent base coat over a colored background 35) of the base coat 34 and preferably the color of indicator coat 36 is a light color. Colorants for the indicator coat 36 include transparent fluorescent dyes such as commercially available Pylakrome Oil yellow, Pylakrome pink, Pylam white, Keyfluor blue, Day Glo marigold orange and Mobay yellow dyes, transparent non-fluorescent dyes such as commercially available Macrolex yellow, Macrolex red, Macrolex blue, and Macrolex orange dyes, and opaque non-fluorescent dyes such as commercially available green production ink, red production ink, blue production ink, orange production ink and yellow production ink dyes. The color of indicator coat 36 and the effective color of base coat 34 are chosen so that, as shown in FIG. 8, when the indicator coat 36 and base coat 34 are in intimate contact the color change system 32 has a first color and when the indicator coat separates from the base coat 34 the color change system 32 has a second color as shown in FIG. 9. Preferably, colors are chosen for the effective color of the base coat 34 such as black and the indicator coat 36 such as orange/yellow so that when the base coat 34 and indicator coat 36 are in intimate contact the color change system 32 appears greenish (for "GO", safe or untampered) and when the indicator coat 36 separates from the base coat 34 the color change system 32 appears orangish or yellowish (for "CAUTION", unsafe or tampered).

As shown in the embodiment of the invention depicted in FIG. 3, the indicator coat 36 can be applied to the button 24 while the button is in its up convex configuration. Application of the indicator coat 36 to the base coat 34 while the button 24 is in its up position allows the color change system 32 to be applied to the closure 10 at the closure manufacturer's facility.

Figure 7:
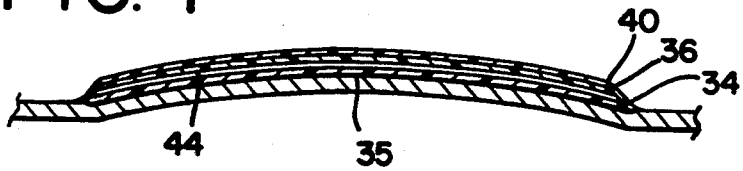
FIG. 7 is an enlarged fragmentary section view through the button after the closure has been removed from the associated container and the button has flexed to its "up" position causing the indicator layer to separate from the substrate layer.

In accordance with the principles of the present invention, the indicator coat 36 is appropriately formulated and applied to the closure 10 to provide a coating which will adhere to the base coat 34 when the button 24 assumes its downward concave vacuum drawn position as shown in FIG. 6 and which will separate from the base coat 34 when the button 24 flips back to its original "up" position as shown in FIG. 7. It will be appreciated that the use of additives such as release agents, lubricants and the like can be incorporated within either the base coat formulation or the indicator coat formulation to facilitate separation of the indicator coat 36 from the base coat 34. It will be appreciated that such release agents can take a variety of forms other than chemical additives, such as scoring the surface of the button or the base coat, perforating the indicator coat, or incorporating solid matter within one or more of the coatings to create stress centers to help initiate separation of the layers. It will also be appreciated, however, that closures having color change systems incorporating enhanced release formulations may have a greater tendency to inadvertently undergo a color change. It will further be appreciated that the formulations can include other components to enhance the bonding between the base coat 34 and the indicator coat 36 so long as the base coat 34 and the indicator coat 36 can still effectively separate to cause a color change. For example, an epoxy ester varnish base coat 34 may contain phenolic resin components to enhance bonding to an indicator coat 36. It will be appreciated that enhanced bonding agents and enhanced release means can also be used in conjunction. For example, means to create a stress center to facilitate release of the indicator coat 36 from the base coat 34 can be used in conjunction with formulations for either base coat 34 or indicator coat 36 which are designed to enhance the bonding between the coats. It is believed that the creation of a stress crack in the indicator coat 36 upon button flipping may facilitate delamination of the indicator coat 36 from the base coat 34.

Figure 4:
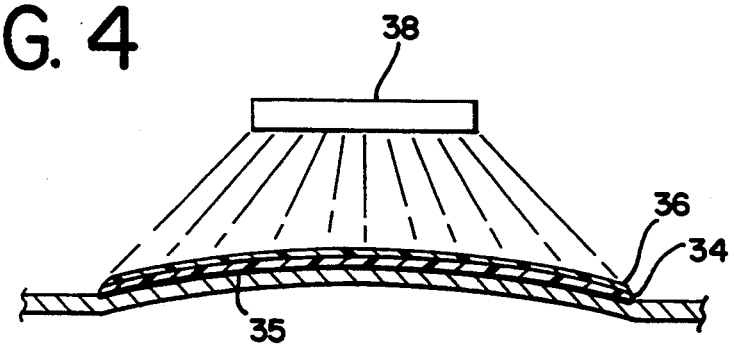
FIG. 4 is an enlarged fragmentary sectional view similar to FIG. 3 with the indicator coating being treated to effect partial curing thereof.

It has been found that the use of resins such as acrylated epoxies, acrylated urethanes and cationically cured epoxies which are capable of multiple stage curing when used to formulate the indicator coat 36 provide a tamper evident system for a closure 10 which can be produced at the closure manufacturer's site and can be then fully "armed" at the packaging site. As best shown in FIGS. 3–6, the indicator coat 36 can be prepared as a liquid mixture which is spread over the base coat 34. Preferably, the indicator coating is spread to a thickness of 5 to 20 mils. As schematically shown in FIG. 4, the indicator coating 36 is partially cured such as by exposure to UV radiation effected by an appropriate UV source 38. Preferably, partial curing of indicator coat 36 is sufficiently effected to provide a relatively non-tacky but flexible solid. It will be appreciated, however, that the indicator coat 36 can be precured to lesser states such as somewhat tacky and even still wet states as desired.

As shown in FIG. 5, after the indicator coat 36 has been partially cured, a flexible transparent coat 40 is applied over indicator coat 36 to seal the indicator coat 36 to the closure 10, to protect color change system 32 during transit and storage and to prevent the indicator coat 36 from falling off closure 10 when the indicator coat 36 delaminates from the base coat 34. The transparent overcoat 40 is formulated so that it does not restrict the flipping action of the button 24 or interfere with the separation of the indicator coat 36 from the base coat 34 upon flipping of button 24 or interfere with the visual appearance of the color change system 32. Examples of materials that can be used to formulate the transparent overcoat 40 include clear, low cross-linked density, acrylated urethanes, two part epoxies and urethanes, and UV curable cationic systems. Additional materials that can be used for overcoat 40 include transparent tape such as clear polypropylene or polyester films which can be bonded to closure 10 such as by adhesively fixing or heat sealing the film to closure 10.

Preferably, a material which reduces the interfacial tension or bonding between the indicator coat 36 and the overcoat 40 is present between such coats to prevent the overcoat 40 from interfering with the separation of the indicator coat 36 from the base coat 34. Such materials include surface active agents like soaps or soap solutions and other surfactants, waxes and other lubricants such as amides and stearates and the like, which can be applied to the indicator coat 36 prior to application of the overcoat 40. It will be appreciated that the curable compositions used for color change system 32 such as the UV curable indicator coat 36 and UV curable overcoat 40 may contain different curing agents and different amounts of curing agents to control the nature and degree of curing. For example, a UV curable indicator coat 36 composition may contain different photoinitiators which can be activated by different UV wavelengths to facilitate multiple stage curing of the indicator coat 36. Additionally, when a UV curable overcoat 40 is used in association with a UV curable indicator coat 36 it may be desirable to utilize different photoinitiators in the indicator coat 36 and the overcoat 40 so that each of the coats can be cured independently of each other and so that the cure of the overcoat 40 does not untimely cure or otherwise interfere with the cure of the indicator coat 36. It will, of course, be appreciated that, if necessary, different UV sources and/or different UV lamps may be used to activate the photoinitiators, as needed.

FIG. 6 shows the closure 10 carrying the color change system 32 after the closure 10 has been applied to a container and the button 24 has been drawn down to its concave position by a vacuum within the container. As schematically shown in FIG. 6, the partially cured indicator layer 36 can then be fully cured to a very stiff cross-linked polymer such as by exposure to higher doses of UV radiation effected by an appropriate UV source 42.

As shown in FIGS. 6 and 8, the fully cured indicator coating 36 is in intimate contact with the base coating 34 so that color change system 32 when viewed through indicator coat 36 has a first color. As noted above, when the button 24 is in the down position of FIG. 6, it has stored energy and is in a state of stress such that when the vacuum is removed by removal of the closure 10 from the container, the button 24 will flex upwardly to its original position as shown in FIG. 7. As shown in FIGS. 7 and 9, when the button 24 flexes upwardly, indicator coat 36 separates from the base coat 34 and color change system 32 when viewed through indicator coat 36 has a second color. It will be appreciated that the separation of indicator coat 36 from base coat 34 creates a reflective interface 44 sufficient that the color perceived is the color of the indicator coat when color change system 32 is viewed through the indicator coat 36. It is believed that a 0.3–0.8 micrometer separation between indicator coat 36 and base coat 34 should provide a sufficient reflective interface 44 to cause color change system 32 to undergo an effective change of color. In accordance with the present invention, if after activation of color change system 32, closure 10 is reapplied to the container and a further vacuum drawn within the container, even though the button 24 will be deflected downwardly, the indicator coat 36 will not rewet to base coat 34 sufficient to eliminate interface barrier 44 and cause the intimate contact necessary to reestablish the first color of color change system 32.

Examples 1–5 illustrate representative formulations for indicator coat 36 which formulations are susceptible to two stage curing. It is presently contemplated that these formulations and an overcoat layer could be applied to the button area 24 of a closure 10 at a closure manufacturer's site. The button area 24 of the closure 10 would already have a dark background 35 such as a black colored background 35 and an epoxy ester varnish base coat 34 applied to the button area 24. After the indicator coat 36 is applied over the base coat 34 the indicator coat 36 is partially cured sufficiently to allow the color change system 32 to withstand application of the closure 10 to the container and the drawing down of the button 24 by a vacuum within the container without cracking or loss of adhesion of the color change system 32. A transparent overcoat 40 then can be applied over the precured indicator coat 36. After the closure 10 is applied to the container and the button 24 is down, the color change system 32 is fully activated by fully curing the indicator coat 36.

EXAMPLE 1

10 parts by weight of a UV curable diacrylate bisphenol A epoxy such as Ebercryl 3700 supplied by Radcure is heated to about 50° C. A photo initiator (0.4 parts by weight) such as Irgacure 184 supplied by Ciba Geigy, fumed silica (0.5 parts by weight) which acts as a suspension agent and opaqifier and an orange fluorescent dye (0.005 parts by weight) such as Marigold Orange supplied by Day Glo are added. The composition is mixed sufficiently to obtain a homogenous mixture of all the components. A cowels mixer can be used to increase the speed and efficiency of the mixing. 50 to 100 mg of the material is applied to the center of an up button of an approximate two inch diameter non-sealed closure. The button portion of the closure would already have a black colored background and base coating applied to the button portion of the closure. The material is then spread to an appropriate shape and size such as a disk shape with a diameter of about $\frac{3}{4}$ of an inch. The material can be spread in any number of ways to achieve the desired result. One method of spreading is to place the cap on a rotating chuck and use a flat ended spatula to apply and spread the material on the cap. Another method of application is to use an apparatus comprising a motorized rotating chuck into which the cap is secured, a doctor blade attached to one end of a stylus arm and profile bar. A cap can be secured into the chuck and the material to be spread can be applied to the center of the button area. The apparatus motor is started and the doctor blade is brought into contact with the material. The stylus end of the stylus arm is traced over the profile bar which determines the movements of the doctor blade across the cap. After the material is applied to the button area of the cap, it can be partially cured to a non-tacky but flexible solid by exposing it to a light dose of UV radiation and an overcoat layer can be applied. After the cap is applied to the container and the button is drawn down, the indicator coat can be fully cured to a very stiff cross-linked polymer upon exposure to higher doses of UV radiation. When the UV cured indicator coat is in intimate contact with the black backgrounded base coat the color change system when viewed through the indicator coat appears dark green. Upon the button up-flip and activation of the tamper evident coating system, the color change system when viewed through the indicator coat appears orange due to the separation of the indicator coat from the base coat.

EXAMPLE 2

Ebecryl 3700 (7.0 parts by weight)) is heated to about 50° C. An opaqifier such as zinc oxide (2.0 parts by weight) and colorants such as Marigold Orange fluorescent dye (0.3 parts by weight) and Mobay yellow fluorescent dye (0.3 parts by weight) are then added. The formulation is mixed with sufficient shearing action to provide a homogenous mixture of all of the components. This mixture is made in order to effectively disperse the dyes and fillers into the indicator formulation in the correct amounts. The main indicator coating can then be formulated by heating Ebecryl 3700 (100 parts by weight) to about 50° C. and then adding the foregoing premix (0.1 part by weight), fumed silica (0.5 parts by weight) and 0.1 part by weight of a long wave length photo initiator such as Lucerin TPO supplied by BASF. The resulting material can be applied to a button closure having a black colored background and a base coat and cured in accordance with the methods set forth in Example 1 above. When the UV cured indicator coat is in intimate contact with the black backgrounded base coat the color change system when viewed through the indicator coat appears dark green. Upon activation of the color change system the color change system when viewed through the indicator coat appears orange/yellow due to separation of the indicator coat from the base coat.

EXAMPLE 3

100 parts by weight of a phenyl based epoxy novolac such as Tactix 785 supplied by Dow Co. is heated to the melt state. One part of a cationic photo initiator such as FX-512 supplied by 3M is then added and the components are mixed. The material is allowed to cool and is then crushed into a granular form. 50 to 100 milligrams of the material is applied to the center of the up button of a non-sealed cap. The button would have a black backgrounded base coat in place. The cap is then heated, on a hot plate or with an IR lamp, until the material goes to the melt state. The melted material is then spread to a diameter of about ¾ of an inch with a stirring rod or a spatula. Upon cooling, the material solidifies. Because the material is solid in its uncured state it is not necessary to go through the precure process of Examples 1 and 2 above. Although thermoplastic phenol formaldehyde type resins typically are cured with cross-linking agents such as amines and anhydrides and heat, this formulation can be cured for the present application by exposure to UV energy. When this material is UV cured it turns red in color. Accordingly, after the closure containing the color change system of the present invention incorporating the formulation of Example 3 is applied to the container and a vacuum is drawn the indicator coat can be cured by exposure to UV radiation. When the UV cured indicator coat is in intimate contact with the black colored base coat the color change system when viewed through the indicator coat appears dark green. Upon button up-flip and activation of the tamper evident coating system, the color change system when viewed through the indicator coat appears red due to the separation of the indicator coat from the base coat.

EXAMPLE 4

A photo initiator and colorant premix is prepared of Darocur 4265 (1.96 parts by weight) photo initiator supplied by EM Industries, Mobay yellow 10 GN (1.3 parts by weight) yellow fluorescent dye supplied by Mobay and Pylachrome pink (0.043 parts by weight) pink fluorescent dye supplied by Pylam Corp. The main indicator coating is prepared by adding Ebecryl 220 (141 parts by weight) UV curable hexafunctional urethane acrylate to a four ounce glass jar. Then a fluoro aliphatic ester surface active agent, surfactant (0.214 parts by weight) used to provide good wetting characteristics of the uncured system to the cap such as FC430 supplied by 3M, white pigment such as titanium dioxide (0.214 parts by weight) used to provide opacity, the foregoing premix (1.430 parts by weight) and about 2.4 parts by weight of fumed silica such as Cab-O-Sil supplied by Cabot Corporation are added. The mixture is stirred gently with a spatula to entrap the silica. An additional amount of 2.4 parts by weight fumed silica is added and the mixture is vigorously stirred with a cowels blade mixture or otherwise appropriately blended such as by a three roll mill. The resulting material can be applied to a button closure having a black backgrounded base coat in accordance with the methods set forth in Example 1 above. The indicator coat can then be precured by exposure to UV radiation. For example, a Suncure Photocure 2785 Lab UV curing unit housing two 12 inch (200 watts/inch) medium pressure mercury vapor lamps can be used to cure the indicator coat. The indicator coat can be precured by exposure to approximately 0.029 Joules/cm$^2$ as measured in the wavelength range between about 320 to 390 nm (1×150 ft/min at full power on the Suncure unit). An overcoat layer can be applied over the precured indicator coat. For instance, an acrylated urethane overcoat can be prepared using an aliphatic urethane diacrylate such as Photomer 6060 supplied by Henkel. The acrylated urethane is placed in a four ounce glass jar and heated on a hot plate for approximately 7 minutes at about 200° C. at which time it should be fluid enough to stir with a glass stirring rod. About 10 parts by weight isobornylacrylate and about 2.5 parts by weight N vinylpyrrolidone can be sequentially added to lower the viscosity, improve elongation, improve hardness and increase the curing speed of formulation. About 1 parts by weight of a photo initiator such as Irgacure 184 is added and the components are mixed well. Additional additives such as surfactants can be added to provide other characteristics such as wetting and scruff resistance to the overcoat layer. For instance, about 0.2 parts by weight of surfactants can be included in the above overcoat formulation to provide wetting and scruff resistance to the overcoat. The overcoat can be applied to the closure such as by applying it in a manner similar to that used to apply the indicator coat to the closure or in any number of other ways to achieve the desired result. The overcoat can then be cured by exposure to approximately 0.026 Joules/cm$^2$ as measured in the wavelength range between about 320 to 390 nm (1×100 ft/min at low power on the Suncure unit). After the closure has been applied to the container and the button is drawn down, the indicator coat can be fully cured to a very stiff-cross-linked polymer by further exposure to approximately 0.518 Joules/cm$^2$ as measured in the wavelength range between about 320 to 390 nm (5×50 ft/min at full power on the Suncure unit). When the UV cured indicator coat is in intimate contact with the black backgrounded base coat the color change system when viewed through the indicator coat appears green. Upon activation of the color change system, the color change system when viewed through the indicator coat appears orange due to separation of the indicator coat from the base coat.

EXAMPLE 5

25 parts by weight of an aromatic diacrylate urethane, PES 198 supplied by Polymer Systems, is heated to 50° C. 25 parts by weight of a bisphenol A epoxy diacrylate such as Henkel 3016 is added to the heated aromatic diacrylate urethane and 50 parts by weight of a hexafunctional aromatic urethane acrylate used to increase cross-linked density such as Henkel 6022 is added. 2 parts by weight of a photo initiator such as Darocur 1173 supplied by EM Industries and 2.5 parts by weight of calcium carbonate which is used to provide opacity are added. A desired amount of a colorant preferably a light colored fluorescent dye can also be added. The formulation can be applied to a dark backgrounded base coat button closure and cured in accordance with the procedures set forth in Example 4 above. When the UV indicator coat is in intimate contact with the black backgrounded base coat the color change system when viewed through the indicator coat will have a first color. Upon activation of the color change system, the color change system when viewed through the indicator coat will have a second color different from the first color due to separation of the indicator coat from the base coat.

It will be appreciated that although the formulations set forth in Examples 1–5, above, have been described in the context of two stage curing systems that such formulations can also be used in a single stage curable system such as by application to a base coating 34 on a button closure 10 which has already been applied to a container and drawn down by a vacuum therein. In such a single stage application, the indicator coat 36 would be subjected to sufficient curing means, such as chemical curing means, thermal curing means or radiation such as UV radiation curing means, to effect the desired amount of curing of the indicator coat 36 resin. Examples 6 and 7 illustrate further representative formulations for indicator coat 36 which formulations are susceptible to single stage curing. It is presently contemplated that these formulations could be applied to the button area 24 of a closure 10 at the packaging site after the closure 10 has been applied to a container and the container is sealed and the button 24 has been drawn to its down position. The button 24 would have a dark background and base coat 34 such as an epoxy ester varnish base coat in place.

EXAMPLE 6

62.5 parts by weight of a diglycidyl ether of Bisphenol A such as DER 332 supplied by Dow Chemical and 62.5 parts by weight of an adduct of 40/60 carboxy terminated butadiene nitrile rubber and bisphenol A type epoxy such as Epirez 58005 supplied by Rohme Poulenc are mixed together until they are a homogenous blend. The materials can be heated slightly such as to 50° C. to lower viscosity and aid mixing. A glass stirring rod can also be used to facilitate mixing of small batches. 2.5 parts by weight of a mercaptan terminated liquid polymer which imparts rapid cure to epoxy resins in combination with selected amines such as Capcure 3-800 supplied by Henkel is then added to the blend and mixed well. 1.0 parts by weight of a tertiary amine which can be used as a catalyst and curing agent such as Capcure EH30 supplied by Henkel is then added and the blend is mixed well. Immediately after mixing a small amount, approximately 100 milligrams of the formulation is deposited over a black backgrounded epoxy ester base coat present on the center of the down button of a sealed cap (the cap being approximately 2 inches in diameter). The container is rotated while the flat end of the spatula is used to spread the material to a disk shape with a diameter of about ¾ of an inch. The indicator coat is then allowed to cure at room temperature for 24 hours. Upon curing, the indicator coat is relatively transparent and, accordingly, the button area when viewed through the indicator coat appears black due to the black colored base coat. Upon button up-flip the indicator coat looses its adhesion to the base coat and the coating and button area when viewed through the indicator coat appears milky white.

EXAMPLE 7

140 parts by weight of a water solution of sodium silicate, $Na_2SiO_3$, (Banco 41 degrees Be solution) is mixed with 3 parts of a premixed water soluble fluorescent dye solution (red and yellow-green fluorescent dyes supplied by Formulas). The dye solution is prepared by adding the concentrated dye to water to produce a super saturated solution. The dye premix is then added to a volume of sodium silicate at a level that will produce the needed degree of color. The proper color intensity is preferably one which will produce an obvious green color when the indicator coating is in contact with a black backgrounded base coating and provides an obvious orange or yellow color when it delaminates from the black base coating. 50–100 microliters of the sodium silicate/dye solution are applied with a syringe or eye dropper to the center of a black backgrounded base coated down button on a sealed cap. The solution is spread to a diameter of approximately ¾ of an inch with a glass stirring rod, spatula or doctor blade. The cap is then heated to about 60° C. to drive-off the water. As previously noted, when dried, the color change system when viewed through the indicator coat will appear green. Upon button up-flip the adhesion is lost between the button surface and the indicator film of sodium silicate which causes the color change system to appear to be yellow or orange (depending upon the color of the dye used) when viewed through the indicator coat.

Figure 10:
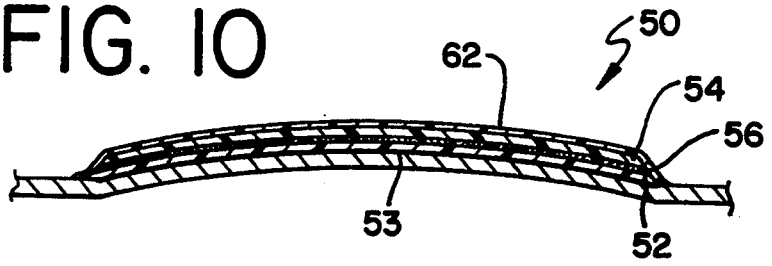
FIG. 10 is an enlarged fragmentary vertical section view similar to that of FIG. 3 which shows further details of an embodiment of the tamper evident system provided on the button including a dark colored substrate layer under a bonding-release layer under an indicator layer under a transparent cover layer.
Figure 11:
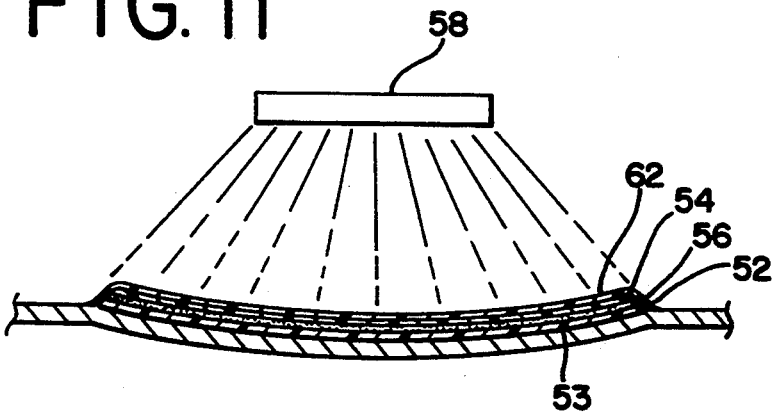
FIG. 11 is a schematic sectional view showing the manner in which the tamper evident system of the embodiment shown in FIG. 10 may be armed after the closure has been applied to a container and the button deformed by a vacuum within the container.
Figure 12:
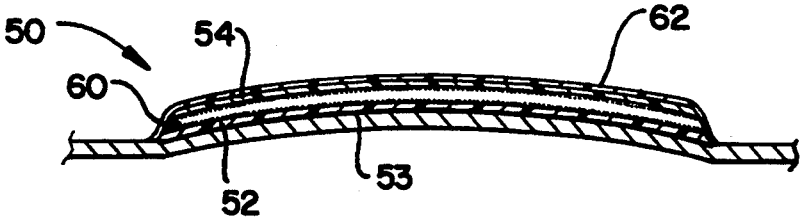
FIG. 12 is an enlarged fragmentary section view through the button of FIG. 11 after the closure has been removed from the associated container and the button has flexed to its "up" position and the bonding-release layer has failed causing the indicator layer to separate from the substrate layer.

Reference is now made to FIGS. 10 through 12 which illustrate an alternate embodiment of the present invention. As shown in FIG. 10, in this embodiment of the invention, a button enhancement color change system generally identified by the numeral 50 comprises a translucent bonding-release layer 56 interposed between a base coat 52 and an indicator layer 54. As in the embodiment of the invention illustrated in FIGS. 3–7, base coat 52 either contains a colorant or is translucent and overlies a colored background coat 53 on the button 24 and base coat 52 is formulated to adhere to the surface of the button 24 and move with the button 24 without separation from the button 24. The indicator layer 54 is translucent and either inherently has a colored appearance or is formulated to include the colorant. In accordance with the principles of the present invention, the color of the indicator layer 54 differs from the effective color of the base coat 52.

The bonding-release layer 56 is interposed between the indicator layer 54 and the base coat 52 to bond the indicator layer 54 to the base coat 52 in an effective intimate contact relationship prior to the breach of the integrity of a container sealed with a closure incorporating the color change system 50. In accordance with the objects of the present invention, the bonding-release layer 56 is translucent so that when the indicator layer 54 and the base coat 52 are in effective intimate contact, the perceived color of the color change system 50 is a function of the combined colors of the layers comprising the color change system 50.

It will be appreciated that the indicator layer 54 can be made from a resin similar to that used for the indicator coat 36 in the embodiment of the invention illustrated by FIGS. 3–7 or the indicator layer 48 can be comprised of a preformed colored translucent material such as a color translucent plastic disc or a colored translucent plastic film.

As shown in the embodiment of the invention depicted in FIG. 10, the indicator layer 54 can be applied to the button 24 over the bonding-release layer 56 while the button 24 is in its up concave configuration. Application of the indicator layer 54 while the button 24 is in its up position allows the color change system 50 to be applied to a closure at the closure manufacturer's facility.

In accordance with the principles of the present invention, the bonding-release layer 56 is appropriately formulated and applied to a closure so that indicator layer 54 and base coat 52 are in effective intimate contact when the button 24 assumes it downward concave vacuum drawn position as shown in FIG. 11 and so that indicator layer 54 irreversibly separates from the base coat 52 when the button 24 flips back to its original "up" position as shown in FIG. 12. Suitable materials for the bonding-release layer 56 include photodegradable adhesives including relatively high molecular weight polymers which can be degraded such as by subjection to UV radiation to reduce or weaken their adhesive properties. Prior to degradation, the photodegradable adhesive can be used to sufficiently bond the indicator layer 54 to the base coat 52 during application of the color change system 50 to the button 24 and the arming of button 24 such as by pulling a vacuum thereon during packaging. It will be appreciated that if a UV curable composition is utilized for the indicator layer 54 and a photodegradable adhesive is utilized for the bonding-release layer 56 that it may be desirable to utilize photoactivators for the indicator layer 54 (e.g. photoinitiator(s) which actuates curing of the composition) and for the bonding-release layer 56 (e.g. photoabsorber which actuates degradation of the composition) which are actuated by different wavelengths or mechanisms. Using different photoactuators for the indicator layer 54 and for the bonding-release layer 56 may be especially desirable to prevent premature degradation of the bonding-release layer 56 when the indicator layer 54 is being exposed to a UV source to fully cure indicator layer 54.

FIG. 11 shows the closure 10 carrying the color change system 50 after the closure 10 has been applied to a container and the button 24 has been drawn down to its concave position by a vacuum within the container. As schematically shown in FIG. 11, the photodegradable bonding-release layer 56 can be degraded to weaken its bonding ability such as by exposure to UV radiation effected by an appropriate UV source 58. For example, it has been found that a photodegradable polystyrene resin such as commercially available Ecolyte PS-2005 resin supplied by Novacor of Leominster, Mass. has certain adhesive properties at its starting molecular weight of 111,000$\overline{M}_n$ and that after exposure to 12–13 Joules/cm$^2$ of UV energy it is degraded to a molecular weight of 86,000$\overline{M}_n$ and its adhesive properties are concomitantly reduced.

As illustrated in FIG. 12, when the closure 10 incorporating color change system 50 is removed from a container and the vacuum applied against the underside of the end panel 12 is released, the button will flip, snap or pop upwardly to its original position. This flexing action of the button 24 is sufficient to disrupt the adhesive ability of the weakened bonding-release layer 56 thereby allowing the indicator layer 54 to separate from the base layer 52. As illustrated in FIG. 12, the adhesive failure of the bonding-release layer 56 results in the creation of a reflective interface or reflection barrier 60 between the indicator layer 54 and the base coat 52 which causes the color change system 50 to undergo a change in color.

As shown in FIGS. 10–12, and as in the embodiment of the invention shown in FIGS. 3–7, the color change system 50 can include a flexible transparent coat 62 which is applied over indicator layer 54 to seal, the indicator layer 54 to the closure 10, to protect the color change system 50 during transit and storage and to prevent the indicator layer 56 from falling off the closure 10 when the bonding-release layer fails and indicator coat 54 separates from the base coat 52.

Although only several preferred embodiments of the invention have been specifically illustrated and described herein, it will be understood that minor variations may be made in the color change system of the present invention without departing from the spirit and scope of the invention as defined by the appended claims.

What is claimed is:

1. A container including a container body and a removable closure sealingly applied to said container body, said closure including a flexible end panel portion having formed therein a sealing state indicating area which can flex from a seal indicating position to a non-seal indicating position due to the release of energy stored within said end panel, said sealing state indicating area carrying an irreversible tamper indicating color change system comprising an effectively dark colored background base layer, a translucent light colored indicator layer, and a degradable bonding-release layer interposed between said base layer and said indicator layer, said degradable bonding-release layer maintaining said base layer and said indicator layer in effective intimate contact with each other when said flexible end panel is in a seal indicating position so that when viewed through said indicator layer said color change system has an effective first color, and when said flexible end panel flexes to its non-seal indicating position, said degradable bonding-release layer allowing said indicator layer to separate from said base layer so that when viewed through said indicator layer said color change system has a second color different from said first color.

2. A closure according to claim 1 wherein said degradable bonding-release layer is photodegradable.

3. A closure according to claim 2 wherein said bonding-release layer is a photodegradable polymer.

4. A closure according to claim 3 wherein said photodegradable polymer is a photodegradable polystyrene.

5. A closure according to claim 1 wherein said indicator layer comprises a colored translucent plastic disc.

6. A closure according to claim 1 wherein said color change system further comprises a transparent overcoat which prevents said indicator layer from falling off said closure when said flexible end panel flexes to its non-seal indicating position and said indicator layer separates from said base layer.

7. A closure according to claim 6 wherein said color change system further comprises means between said indicator layer and said overcoat to inhibit bonding between said indicator layer and said overcoat.

8. A closure according to claim 7 wherein said means comprising a surfactant.

9. A closure according to claim 1 further comprising means for creating a stress center to facilitate separation of said indicator layer from said base layer when said flexible end panel flexes to its non-seal indicating position.

10. A container including a container body and a removable closure sealingly applied to said container body, said closure including a flexible end panel portion having formed therein a sealing state indicating area which can flex from a seal indicating position to a non-seal indicating position due to the release of energy stored within said end panel, said sealing state indicating area carrying an irreversible tamper indicating color change system comprising an effectively dark colored background base layer, a translucent light colored indicator layer, and a degradable bonding-release layer interposed between said base layer and said indicator layer, said degradable bonding-release layer maintaining said base layer and said indicator layer in effective intimate contact with each other when said flexible end panel is in a seal indicating position so that when viewed through said indicator layer said color change system has an effective first color, and when said flexible end panel flexes to its non-seal indicating position, said degradable bonding-release layer allowing said indicator layer to separate from said base layer so that when viewed through said indicator layer said color change system has a second color different from said first color, said color change system further comprising a transparent overcoat which prevents said indicator layer from falling off said closure when said flexible end panel flexes to its non-seal indicating position and said indicator layer separates from said base layer.

11. A closure according to claim 10 wherein said color change system further comprises means between said indicator layer and said overcoat to inhibit bonding between said indicator layer and said overcoat.

12. A closure according to claim 11 wherein said means comprises a surfactant.

13. A closure according to claim 10 further comprising means for creating a stress center to facilitate separation of said indicator layer from said base layer when said flexible end panel flexes to its non-seal indicating position.

14. A closure having an end panel including a package condition indicating deflectable button, said button deflectable between a seal indicating position and a non-seal indicating position, and tamper indicating means carried by said button to permanently indicate that said closure has been applied to a container and removed, said tamper indicating means comprising a first colored coating layer bonded to said button, a second colored translucent layer releasably bonded to an exterior surface of said first colored coating layer, and a transparent overcoat layer covering said second colored layer, said colors of said layers combining to display one color when said button is in a seal indicating position and said first and second colored layers are in intimate contact with each other and said layers separating from each other when said button deflects to a non-seal indicating position to display only the color of said second colored translucent layer and said overcoat layer preventing said second colored layer from falling off said closure when said second colored layer separates from said first colored layer, said closure further comprising means between said second colored layer and said overcoat layer to inhibit bonding between said second colored layer and said overcoat layer.

15. A closure according to claim 14 wherein said means comprises a surfactant.

16. A closure according to claim 14 further comprising means for creating a stress center to facilitate separation of said first and second colored layers.

17. A closure according to claim 16 wherein said means comprises particulate matter contained within said first colored layer.

18. A closure according to claim 16 wherein said means comprises particulate matter contained within said second colored layer.

19. A closure according to claim 16 wherein said means comprises scoring on said button.

* * * * *